US012551040B2

(12) United States Patent
Tsunoda

(10) Patent No.: US 12,551,040 B2
(45) Date of Patent: Feb. 17, 2026

(54) PILLOW

(71) Applicant: Noriomi Tsunoda, Tokyo (JP)

(72) Inventor: Noriomi Tsunoda, Tokyo (JP)

( * ) Notice: Subject to any disclaimer, the term of this patent is extended or adjusted under 35 U.S.C. 154(b) by 166 days.

(21) Appl. No.: 18/290,106

(22) PCT Filed: Apr. 13, 2022

(86) PCT No.: PCT/JP2022/017661
§ 371 (c)(1),
(2) Date: Nov. 9, 2023

(87) PCT Pub. No.: WO2022/244559
PCT Pub. Date: Nov. 24, 2022

(65) Prior Publication Data

US 2024/0251974 A1 Aug. 1, 2024

(30) Foreign Application Priority Data

May 19, 2021 (JP) ..... 2021-084314

(51) Int. Cl.
*A47G 9/10* (2006.01)

(52) U.S. Cl.
CPC ..... *A47G 9/109* (2013.01)

(58) Field of Classification Search
CPC ..... A47G 9/10; A47G 9/109; A47G 9/1027; A47G 2009/1018
See application file for complete search history.

(56) References Cited

U.S. PATENT DOCUMENTS 5,644,810 A * 7/1997 Kato ..... A47G 9/109 5/490
5,809,594 A * 9/1998 Isogai ..... A47G 9/10 5/644

(Continued)

FOREIGN PATENT DOCUMENTS

CA 2611516 A1 * 12/2006 ..... A47G 9/0253
CN 101002652 A 7/2007

(Continued)

OTHER PUBLICATIONS

International Search Report and Written Opinion dated May 31, 2022, issued by the international Searching Authority in International Patent Application No. PCT/JP2022/017661.

(Continued)

*Primary Examiner* — David E Sosnowski
(74) *Attorney, Agent, or Firm* — ArentFox Schiff LLP

(57) ABSTRACT

Provided with a bag body and a plurality of accommodated members housed therein, provided with a cervical spine support part to support cervical spine; an occipital support part to support an occiput, having a smaller height than the cervical spine support part and connected to the cervical spine support part; and two temporal head support parts to support a temporal head, connected to the cervical spine support part and arranged to put the occipital support part from both side in, a soft filler material filling a front pouch forming the cervical spine support part and a granular filler material filling a back pouch, the granular filler material housed in a front filler material of the temporal head support part, a sheet-like molded body housed on a back side of the occipital support part from a back side of the temporal head support part.

5 Claims, 7 Drawing Sheets

(56) References Cited

U.S. PATENT DOCUMENTS

| | | | | |
|---|---|---|---|---|
| 6,363,557 | B2 * | 4/2002 | Chou | A47G 9/10 5/636 |
| 6,671,906 | B1 * | 1/2004 | Milligan | A47G 9/10 5/636 |
| 6,817,049 | B1 * | 11/2004 | Hall | A47G 9/109 5/636 |
| 6,993,800 | B2 * | 2/2006 | Greenawalt | A47G 9/10 5/639 |
| 11,980,312 | B1 * | 5/2024 | Duong | A47G 9/1081 |
| 2002/0138908 | A1 * | 10/2002 | Wang | A47G 9/10 5/636 |
| 2005/0217029 | A1 * | 10/2005 | Funatogawa | A47G 9/109 5/636 |
| 2006/0123547 | A1 * | 6/2006 | Ferber | A47G 9/10 5/636 |
| 2011/0094033 | A1 * | 4/2011 | Lee | A47G 9/109 5/636 |
| 2015/0089743 | A1 * | 4/2015 | Haworth | A47G 9/109 5/636 |
| 2016/0296031 | A1 * | 10/2016 | Sramek | A61F 5/56 |
| 2018/0184820 | A1 * | 7/2018 | Johnson | A47G 9/109 |
| 2020/0214481 | A1 * | 7/2020 | Sexton | A61H 1/0218 |
| 2020/0268183 | A1 * | 8/2020 | Murphy | A47G 9/109 |
| 2021/0037996 | A1 * | 2/2021 | Liu | A47G 9/1054 |
| 2022/0079360 | A1 * | 3/2022 | Broadbelt | A47G 9/10 |
| 2023/0190017 | A1 * | 6/2023 | Lalo | A47G 9/1081 5/636 |
| 2024/0138600 | A1 * | 5/2024 | Tantisari | A47G 9/109 |
| 2024/0260770 | A1 * | 8/2024 | Baek | A47G 9/109 |

FOREIGN PATENT DOCUMENTS

| | | | | |
|---|---|---|---|---|
| JP | H05-95368 | U | 12/1993 | |
| JP | H08-422 | A | 1/1996 | |
| JP | H11-253287 | A | 9/1999 | |
| JP | 3096217 | U | 9/2003 | |
| JP | 3131886 | U | 5/2007 | |
| JP | 3169132 | U | 7/2011 | |
| JP | 2012-135510 | A | 7/2012 | |
| JP | 2016-106908 | A | 6/2016 | |
| JP | 3215283 | U | 3/2018 | |
| JP | 2020-116281 | A | 8/2020 | |
| KR | 200430097 | Y1 | 11/2006 | |
| KR | 102364405 | B1 * | 2/2022 | A61F 5/30 |
| WO | 2018097639 | A1 | 5/2018 | |

OTHER PUBLICATIONS

Chinese Office Action dated Jul. 8, 2023, issued by the Chinese Patent Office in Chinese Patent Application No. 202280004602.7.
Chinese Office Action dated Feb. 9, 2024, issued by the Chinese Patent Office in Chinese Patent Application No. 202280004602.7.

* cited by examiner

PILLOW

BACKGROUND OF THE INVENTION

Technical Field

The present invention relates to a pillow that can secure an airway without causing neck muscle tension while lying. The present application is a National Stage entry of International Application No. PCT/JP2022/017661, filed Apr. 13, 2022, which claims priority to Japanese Patent Application No. 2021-084314, filed May 19, 2021. The disclosures of the priority applications are incorporated in their entirety by reference herein.

Background Art

Conventionally, a modern disease called straight neck, in which the cervical spine does not curve naturally but form a straight shape, has been a problem. Custom-made pillows are available to alleviate such straight necks. However, even if pillows are custom-made, there are cases in which the pillows do not fit after a certain period of time, resulting in insomnia, because the pillows are made according to the individual's degree of muscle tension and distortion at the time of pillow creation.

In order to cope with such a situation, it is known that a pillow described in Patent Literature 1 can easily adjust the height, etc. at a certain point so that it can be easily adapted to the shape of the cervical spine of a person lying on it. In the pillow described in the Patent Literature 1, the neck side of the pillow, which is in contact with the neck area when lying, is higher than the support section, which is in contact with the occiput and supports the head; the neck side and support section of the pillow are formed being divided; the neck side and support section are stored in a pillow case; and the bag of the support section filled with buckwheat hulls is partially foldable to adjust the filling height of the buckwheat hulls.

On the other hand, although the pillow of Patent Literature 1 secures the airway when sleeping to face upwards even if the patient has a straight neck, it cannot secure the airway when turning over and sleeping on the side because it cannot support the head position. To address such a problem, pillows that enable stable sleep in both supine (lying on one's back) and recumbent (lying on one's side) positions are known, for example, as described in Patent Literature 2 and Patent Literature 3.

The pillow described in Patent Literature 2 has an occipital support section that supports the occiput when supine, a neck support section that supports the neck, and two lateral head supports that support the lateral (side) head when recumbent, located on both sides of the occipital and neck support sections. The height of these occipital and neck support sections is adjusted so that the height of the nose and chin are approximately horizontal when supine, and the height of the lateral head supports is adjusted so that the cervical and thoracic spines are approximately in line with each other when recumbent. In addition, there is a shoulder support made of soft polyurethane foam with a density of 0.2 or less and a thickness of 10 to 40 mm; in addition, the lateral head support is set at least 3 cm higher than the neck support section.

Also, the pillow described in Patent Document 3 has a pair of repulsive elastic sections, a head support section, and a cervical spine support section. A pair of the repulsive elastic sections are located on both sides of the width direction. The head support section is located between a pair of the repulsive elastic sections. The cervical spine support section is located adjacent to the head support section in the depth direction perpendicular to the width direction and between a pair of the resilient elastic sections. The height of each of the pair of repulsive elastic sections is greater than the height of the cervical spine support section, and the height of the head support section is less than the height of the cervical spine support section. The interior of each of the pair of repulsive elastic sections is filled with polyester fibers, the polyester fibers have at least one or more holes extending along the longitudinal direction, and the polyester fibers contain spiral portions.

CITATION LIST

Patent Literature

Patent Literature 1: Japanese Unexamined Patent Application, First Publication No. H08-422

Patent Literature 2: Japanese Unexamined Patent Application, First Publication No. H11-253287

Patent Literature 3: Japanese Utility Model Registration No. 3215283

SUMMARY OF INVENTION

Technical Problem

However, in the pillow described in Patent Literature 2, the cervical spine support section is formed by foamed polystyrol, so although the airway can be secured, the neck muscles are supported in a tense state.

In the pillow described in Patent Literature 3, the inside of the cervical spine support section is filled only with hollow pipes (resin pipes), so the cervical spine support section sinks too much under the weight of the head, causing the neck muscles to be pulled, and in this case the neck muscles are still supported in a tense state. Furthermore, as shown in FIG. 13, when the shoulder joint is raised toward the neck (shoulder joint is raised in the direction indicated by the arrow in FIG. 13) with the user's side head supported, the skull is pushed obliquely upward by the shoulder joint, and the load on the side head of the skull (area P1 surrounded by the circle shown in FIG. 14) increases, it is stressful.

The present invention is achieved in consideration of the above circumstances, and has an object to provide a pillow that can secure the airway without causing tension in the neck muscles in both lying on the back and on the side, and that is also effective in alleviating straight neck.

Solution to Problem

The pillow of the present invention is a pillow provided with a bag body and a plurality of kinds of accommodated members housed in the bag body, when a head of a human body in a supine posture is placed on the pillow, a direction along the left-right direction is a width direction and a direction along a height direction of the human body is a front-back direction, the pillow provided with a cervical spine support part provided along the width direction to support cervical spine; an occipital support part connected to a rear edge of the cervical spine support part at a center in the width direction to support an occiput; and two temporal head support parts connected to both ends of the rear edge of the cervical spine support part and connected to both side edges of the occipital support part to support a temporal head. The cervical spine support part is provided with a top along the width direction; a thinnest part with a smallest height is provided in the occipital support part; surfaces of the temporal head support parts slope downward from the cervical spine support part toward a rear and the surfaces from the temporal head support part to the occipital support part slope downward toward the thinnest part; the bag body is provided at least with a cervical spine front pouch and a cervical spine back pouch dividing the cervical spine support part into a front side layer and a back side layer, two temporal head front pouches forming a front side of the temporal head support parts, and a posterior back pouch that connects lower spaces of the temporal head front pouches through a lower space of the occipital support part; the accommodated members are provided with a flexible soft filler material, a granular filler material with greater resilience than the soft filler material, and a sheet-like molded body formed in a sheet shape; and the cervical spine front pouch is filled with the soft filler material, the cervical spine back pouch is filled with the granular filler material, and the posterior back pouch stores the sheet-like molded body.

Here, the term "height" refers the height of each part of the pillow from a flat surface when the pillow is placed on the flat surface.

In the present invention, the cervical spine support part, the occipital support part, and the temporal head support parts are integrated by the bag body, and the cervical support portion is provided along the width direction, and inclination of the surfaces each supporting the cervical spine, the occipital and the temporal head are set as described above, so that the cervical spine, the head, and the temporal head are properly supported respectively whether a person lies on the back or side, the air way can be secured without putting stress on the cervical spine.

In this case, the cervical spine support part has a two-layer structure with the front side layer and the back side layer; the front side layer, which is filled with the soft filler material, gently supports the cervical spine in a wrapping manner, while the back side layer, which is filled with the granular filler material and has high resilience, can support the cervical spine at a predetermined height.

Here, if the cervical spine support part consists only of a layer of the granular filler material, the resilience of the cervical spine support part may become too large, and depending on the hardness and shape of the granular filler material, it may also put stress on the cervical spine. On the other hand, if the cervical spine support part consists only of a layer of the soft filler material, the resilience of the cervical spine support part may become too small, and the height of the cervical spine support part may decrease due to deterioration over time. If it is a single layer of a mixture the granular filler material and the soft filler material, rather than a two-layer structure, the height may become smaller or lose its shape as it deteriorates over time.

Therefore, in the cervical spine support part in the above-mentioned manner, by filling the back side layer with the granular filler material and the front side layer with the soft filler material, the soft filler material of the front side layer is supported by the back side layer filled with the granular filler material, preventing the cervical spine support part from losing its shape and reducing the load on the cervical spine.

In addition, the cervical spine support part is formed along the width direction of the pillow, the height of the temporal head support part is progressively smaller toward the back, and there is a gentle slope between the occipital support part and the temporal head support part, so that when changing the body position from lying on the back to lying on the side, the head position can be easily changed; in addition, the pillow can support the pillow user's temporal head while allowing it to sink appropriately when the user turns over, thereby avoiding unnecessary tension on the cervical spine.

In particular, although the shoulder joint is adducted and internally rotated when turning over naturally, the cervical spine can continue to be supported by the cervical spine support part, and since the height of the temporal head support part is formed lower on the back side, the temporal head can be supported appropriately and the upper body can be supported stably at the three areas of the posterior humerus, scapular spine and acromion, so that the cervical spine is not subject to excessive tension when the patient is turned in bed.

In particular, a user lying on a bed or mattress will experience a greater load on the neck and shoulders as the mattress sinks under the weight of the body and the pillow rises relatively high; but in the present invention, since the height of the occipital support part is formed quite low, even for a user using a bed or mattress, it is possible to reduce the load on the cervical spine and shoulders.

Furthermore, as shown in FIG. 13, even when the shoulder joint is raised toward the neck and the skull is pushed obliquely upward while the user's temporal head is supported, the height (thickness) of the temporal head support part is progressively smaller toward the back, so the temporal head of the skull can be properly supported and the load on area the P1 of the skull (see FIG. 14) can be reduced.

In the pillow of the present invention, the cervical spine support part is preferable that the cervical spine front pouch and the cervical spine back pouch be joined at their front edge, and a dimension of the front-back direction of the back side layer be smaller than a dimension of the front-back direction of the front side layer.

In the cervical spine support part, the back side layer has the dimension of the front-back direction smaller than the front side layer, so that when the cervical spine is supported, the vicinity of the rear edge of the front side layer, which is not supported by the back side layer, warps to form a gentle slope inclining from its apex toward the rear, and the occipital support part is continued to that slope, thereby properly supporting the occipital and the cervical spine along its surface shape.

In this case, the dimension of the front-back direction of the back side layer in the cervical spine support part is preferably ½ or more and ¾ or less of the dimension of the back-front direction of the front side layer.

The height of the back side layer of the cervical spine support part is preferably 10% or more and 30% or less of the height of the cervical spine support part.

In the pillow of the present invention, it is preferable that the granular filler material be filled in the temporal head front pouches, a filling density in the temporal head front pouches be smaller than a filling density in the cervical spine back pouch, and the granular filler material be possible to move within the temporal head front pouches.

In the temporal head support part, by arranging the sheet-like molded material on the back side and the granular filler material on the front side, it is easy to secure the necessary thickness with the sheet-like molded body, while the granular filler material can properly support the temporal head along its surface shape.

Here, if the temporal head support part is only a layer of the granular filler material, the resilience of the temporal head support part may be small, and depending on the hardness and shape of the granular filler material, it may put stress on the temporal head. On the other hand, if the temporal head support consists only of a layer of sheet-like molded body, depending on its shape, it may not be able to properly support the temporal head along its surface shape when turning over.

In addition, since the backside of the occipital and temporal head support parts are supported by the sheet-like molded body, the stability of the pillow can be improved and the arrangement will not be disturbed by turning over.

In addition, since the granular filler material is movable within the temporal head front pouches, by turning over, the granular filler material moves with the movement of the head to support the temporal head at an appropriate height.

In this case, it is desirable that the temporal head front pouches have a seam part along the width direction in the central part, excluding its outer circumference, which are made by sewing a part of the temporal head front pouches together in a linear manner.

If the seam part is formed in the width direction except for the outer circumference, it facilitates the movement of the granular filler material when turning over, while at the same time preventing unbalanced placement of the granular filler material.

In the pillow of the present invention, it is preferable that the surface of the temporal head support part slope downward from a connection with the cervical spine support part toward the rear, and an inclination angle to a horizontal plane is a first angle and be larger at a connection side with the cervical spine support part and a second angle and be smaller at a center in the front-back direction.

The surface of the temporal head support part is sloped at two levels, so that between the cervical spine and the temporal head can be supported at an appropriate height when lying on the side.

A preferred aspect of the pillow of the present invention is preferably that the height of the thinnest part of the occipital support part be 1 cm or more and 2 cm or less, and the height of the top of the cervical spine support part be 3 times or more and 9 times or less of the height of the occipital support part.

If the thickness of the thinnest part is less than 1 cm, the height of the occipital support part may be too small to properly support the occiput. If the height of the thinnest part exceeds 2 cm, the cervical spine may not be properly supported by the cervical spine support part. The height of this thinnest part (height of the occipital support part) be more preferably 1 cm or more and 1.5 cm or less.

In the above aspect, the height of the occipital support part is as small as 1 cm to 2 cm, and the height of the cervical spine support part and the height of the temporal head support part are both three times or more than the occipital support part, so that when the occiput is placed on the occipital support part, the cervical spine is properly supported by the cervical spine support part, and the neck muscles can be certainly prevented from being tense.

As a preferred aspect of the pillow of the present invention, when the pillow is compressed to a maximum load of 6 kgf at a speed of 10 mm/min using a 100 mm diameter disc-shaped compression jig, a linearity of compression property of the cervical spine support part is LC1, a linearity of compression property of the temporal head support part is LC2, a compression workload of the cervical spine support part is WC1 (mm gf/78.5 $cm^2$), a compression workload of the temporal head support part is WC2 (mm gf/78.5 $cm^2$), RC1 (%) for a recovery amount of compression of the cervical spine support part, and RC2 (%) for a recovery amount of compression of the temporal head support part, LC1<LC2, WC1>WC2, and RC1>RC1.

The linearity of the compression property is a parameter that indicates the ease of compression in an initial stage of compression, with smaller values indicating a material that is easier to compress in the initial stage of compression. The compression workload is a parameter that indicates the overall ease of compression; a higher value indicates that a material is easier to compress. The recovery amount of compression is a parameter that indicates the material's recoverability after compression; a larger value indicates that the material easily recovers its shape. In other words, in the above aspect, the cervical spine support part is superior to the temporal head support part in ease of compression at the initial stage of compression, as well as in overall compressibility, and in recovery after compression.

In a preferred aspect of the pillow of the invention, the soft filler material is made of polyester fluff, the granular filler material is made of resin pipes, and the sheet-like molded body is a single urethane sheet made of polyurethane foam.

In the above aspect, since the sheet-like molded body is formed of a single urethane sheet, the height of the occipital support part can be changed as needed simply by changing the thickness of the urethane sheet.

In a preferred aspect of the present invention, each of the cervical spine front pouch, the cervical spine back pouch, the occipital front pouch, the temporal head front pouches, and the posterior back pouch of the bag body preferably have an opening and a stopper that can open and close the opening.

In the above aspect, it is possible to replace the accommodated members or otherwise and also possible to adjust the amount of the granular filler material or soft filler material forming the cervical spine support part, occipital support part and temporal head support part, thereby maintaining a state of proper supporting the pillow user's head and cervical spine. In other words, the height of each support portion can be prevented from changing due to over time.

In a preferred aspect of the present invention, the soft filler material, the granular filler material, and the sheet-like molded body may have antibacterial and deodorizing functions.

In the above aspect, the pillow can be kept clean due to the antibacterial and deodorizing effects of these components.

Advantageous Effects of Invention

According to the invention, the airway can be secured without causing tension in the neck muscles in either the recumbent or supine posture, and straight neck can also be alleviated.

BRIEF DESCRIPTION OF DRAWINGS

FIG. 13 It is a schematic view showing a state in which the user's temporal head is supported by the pillow and the shoulder joint is raised toward the neck.

FIG. 14 It is a schematic view showing a temporal head of a scull.

DESCRIPTION OF EMBODIMENTS

Figure 1:
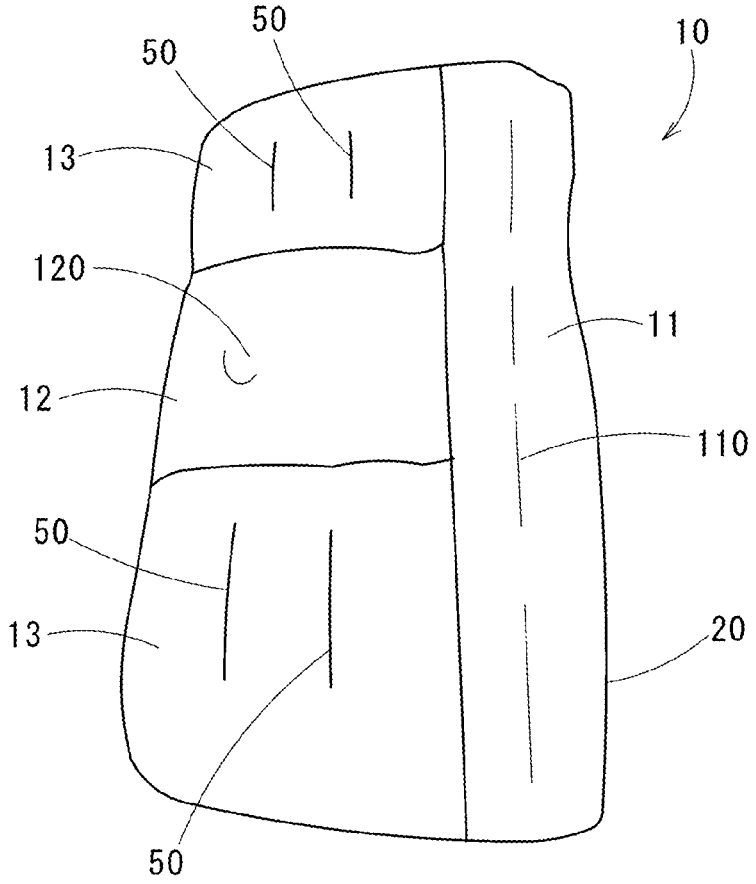
FIG. 1 It is a perspective view of a pillow of one embodiment of the present invention.

The following is a description of one embodiment of a pillow according to the present invention, using the drawings. In this specification, a direction along a left-right direction when a head of a human body in a supine posture is placed is a width direction, and a direction along a height direction of the human body is a front-back direction (or a depth direction). In the top view of FIG. 2, the left-right direction is the width direction, the up-down direction is the front-back direction (or the depth direction); the direction orthogonal to the width direction and the front-back direction is a height direction (or a thickness direction) of a pillow.

[Configuration of Pillow]

A pillow 10 of the present embodiment is a pillow used by a user at bedtime, and is effective, for example, for patients with straight neck symptoms. The pillow 10 has a bag body 20 and accommodated members (soft filler material 31, granular filler material 32, and a sheet-like molded body 33) that are contained in the bag body 20, and has dimensions of 60 cm to 80 cm in the width direction and 35 cm to 55 cm in the depth direction when viewed in plan from a surface side. For example, in the example shown in FIGS. 1 and 2, dimension along the width dimension is 70 cm and dimension along the depth dimension is 45 cm.

Figure 2:
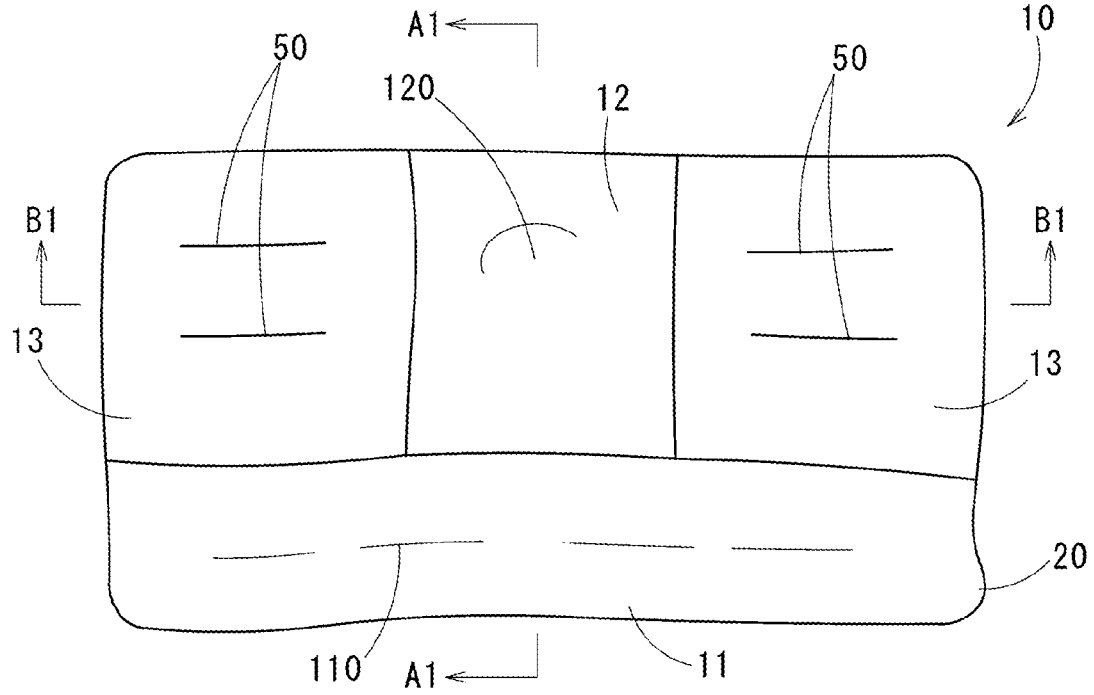
FIG. 2 It is a top view of the above-mentioned embodiment.

As shown in FIGS. 1 and 2, the pillow 10 has a cervical spine support part 11 provided along the width direction and for supporting the cervical spine, a occipital support part 12, which is smaller in height than the cervical spine support part 11 and is connected to a center portion of the width direction of a rear edge of the cervical spine support part 11 to support the occipital, and two temporal support portions 13 connected to both ends of the rear edge of the cervical spine support part 11, respectively, for supporting the temporal heads, and connected to both side edges of the occipital support part 12 so as to sandwich the occipital support part 12 from both sides.

The cervical spine support 11 is located over the entire width direction of the pillow 10 and in front of the pillow 10 in the depth direction of the pillow 10, and supports the cervical spine of the user of the pillow 10 when the user lies on his/her back (supine posture) and side (recumbent position). The occipital support part 12 is located at the center of the pillow 10 in the width direction and at the back (rear) side in the depth direction of the pillow 10, and supports the occipital of the user when the user of the pillow 10 lies on his/her back.

Each temporal head support part 13 is positioned on both sides (outside) of the pillow 10 in the width direction relative to the occipital support part 12, and supports the temporal head of the user of the pillow 10 in a recumbent position when the occipital of the user supported by the occipital support part 12 moves as the user turns from the supine posture to the recumbent position. In other words, the pillow 10 of this embodiment is configured to properly support the user's head and cervical spine, whether the user is lying on his/her back or side.

In this case, the cervical support portion 11 has a top 110 that is taller than the others along the width direction; the occipital support part 12 has a thinnest part 120 that is the smallest in height; a surface of the temporal head support parts 13 slopes downward from the cervical spine support part 11 toward the rear, and a surface from the temporal head support part 13 to the occipital support part 12 slopes downward toward the thinnest part 120.

The bag body 20 is formed of fibrous material, for example, chemical fibers such as polyester fiber or plant fibers such as cotton. The material forming the bag body 20 may be different on a front surface where the user's head is placed (FIGS. 1 and 2 show the front surface) and on a back surface opposite the front surface, for example, the front surface may be 100% polyester fiber and the back surface may be a blend of 65% cotton and 35% polyester fiber.

The bag body 20 has a cervical spine front pouch 201 and a cervical spine back pouch 202 that divide the cervical spine support part 11 into a front side layer 111 and a back side layer 112; two temporal head front pouches 203 that constitute the front part of the temporal head support part 13; a occipital front pouch 204 that constitutes the surface of the occipital support part 12; and a posterior back pouch 205 connecting lower spaces of the temporal head front pouches 203 through a lower space of a occipital support part 12 to form a flat space. Thus, it has four sacks on the front side (cervical spine front pouch 201, two temporal head front pouches 202, and occipital front pouch 204) and two on the back side (cervical spine back pouch 202 and posterior back pouch 205) for a total of six pouches.

Figure 3:
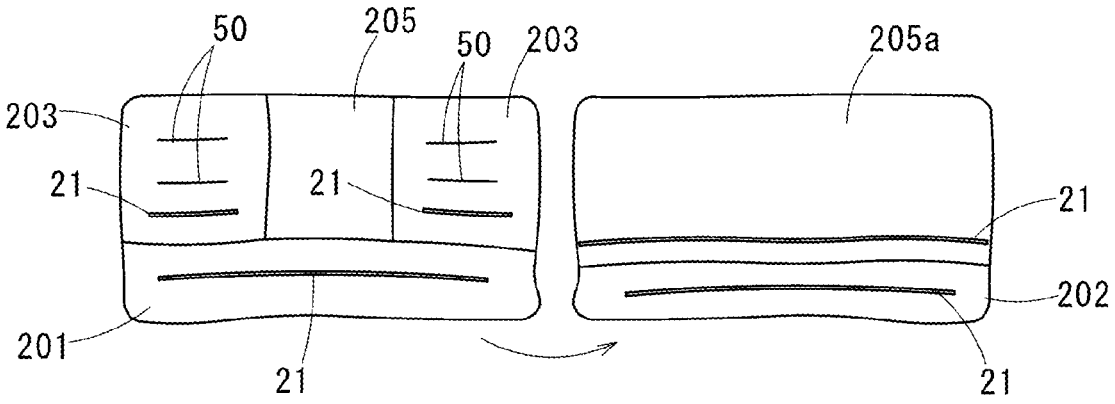
FIG. 3 It is a view of the front and back sides of the pillow of the above-mentioned embodiment unfolded, separated and lined up.

In FIG. 3, the bag body 20 is separated to the front side and the back side and placed side by side on the left and right with their mating surfaces facing up. In this FIG. 3, the left side shows a component making the front side and the right side shows a component making the back side. As shown in this FIG. 3, in the bag body 20, the cervical spine front pouch 201, the temporal head front pouches 203, and the occipital front pouch 204 which constitute the front side are connected as one piece; and on the other hand, a lining 205*a* extending over the entire occipital support part 12 and the temporal head support parts 13 is integrally connected to the cervical spine back pouch 202 constituting the back side. These front and back sides are then overlapped as indicated by the arrows and by sewing their peripheries together, the cervical spine front pouch 201, the temporal head front pouches 203, and the occipital front pouch 204, which constitute the front side, are overlaid with the cervical spine back pouch 202 and the lining 205*a*, so that the posterior back pouch 205 is formed. In this case, the cervical spine front pouch 201 and the cervical spine back pouch 202 are almost close to each other by filling the soft filler material 31 and granular filler material 32, and the space between these cervical spine front pouch 201 and cervical spine back pouch 202 is almost eliminated; so that the posterior back pouch 205 is essentially formed by the space located behind the cervical spine support part 11.

To make it easier for the user to recognize the cervical spine support part 11, the occipital support part 12, and the temporal head support part 13, each pouch (four pouches) located on the front side may preferably be colored differently, but all may be colored the same.

Each of the other pouches 201 to 205 of the bag body 20, except for the occipital front pouch 114, is provided with an opening (not shown) and a stopper 21 that can open and close this opening, so that each of the pouches 201 to 205 can be filled with accommodated members 31, 32, and 33 as appropriate through the opening. Buttons and buttonholes, hooks, snaps, metal or plastic fasteners, zippers, or hook and loop fasteners are used as the stoppers 21.

(Composition of Cervical Spine Support Part)

In the cervical spine support part 11, the cervical spine front pouch 201 of the bag body 20 is filled with the soft filler material 31 and the cervical spine back pouch 202 is filled with a number of the granular filler materials 32. As the soft filler material 31, easily deformable fluff (whether plant, animal, or synthetic fibers) is suitable, e.g., polyester fiber processed into fluff-like material, which has excellent flexibility. A part (e.g., 50%) of the polyester fluff forming the front side layer 111 has antibacterial and deodorizing functions.

As the granular filler material 32, a number of elastically deformable pipes (resin pipes, including spherical shells such as round beads, in addition to cylindrical ones) are suitable. For example, it is a resin pipe formed by polyethylene resin, whose length is 5 mm to 20 mm and outer diameter is 5 mm to 10 mm. The polyethylene resin that forms the resin pipe also contains Bincho-tan charcoal. In other words, the resin pipe has antibacterial and deodorizing functions.

The cervical spine back pouch 202 is filled with the granular filler material 32 so as to fill the gap to the extent that the free movement of the granular filler material 32 is restricted.

Thus, in the cervical spine support part 11, the resilience of the back side layer 112 is formed greater than that of the front side layer 111. In other words, the layer of the soft filler material 31 in the front side layer 111 is supported by a layer of the granular filler material 32 in the back side layer 112, so as to prevent the cervical spine support part 11 from losing its shape and reduces the load on the cervical spine.

If the entire cervical spine support part 11 is a layer consisting solely of the soft filler material 31, its height may become smaller by aging deterioration. On the other hand, if the entire cervical spine support part 11 is a layer consisting solely of the granular filler material 32, the cervical spine may be stressed, depending on the hardness and shape of the granular filler material 32. If these soft filler material 31 and granular filler material 32 are mixed, i.e., are not divided into individual layers, they may become smaller in height or lose their shape by aging deterioration.

A height h1 of the top 110 of the cervical spine support part 11 is set to be 3.0 times or more and 9.0 times or less a height h2 of the thinnest part 120 of the occipital support part 12 (e.g., 6.0 cm or more and 9.0 cm or less in this embodiment, more preferably 7.0 cm or more and 8.0 cm or less). A height of the back side layer 112 in the cervical spine support part 11 is set 10% or more and 30% or less of the overall height h1 of the cervical spine support part 11.

If the height of the back side layer 112 is less than 10% of the height h1 of the cervical spine support part 11, the back side layer 112 becomes too thin and it is difficult to suppress changes in the height h1 of the cervical spine support part 11 due to the age deterioration; or if it exceeds 30%, it is difficult to inhibit the pillow 10 from losing its shape.

A width dimension of the cervical spine support part 11 is 60 cm to 80 cm, the same as the width dimension of the pillow 10, and a depth dimension is 10 cm to 20 cm. Furthermore, the cervical spine front pouch 201 and the cervical spine back pouch 202 of the cervical spine support part 11 are joined at their anterior edges, and the dimension of the front-back direction of the cervical spine back pouch 202 is smaller than that of the cervical spine front pouch 201. For example, a dimension L1 of the front-back direction of the back side layer 112 in the cervical spine support part 11 is ½ or more and ¾ or less of a dimension L2 of the front-back direction of the front side layer 111; and a rear edge of the front side layer III is unsupported by the back side layer 112 below it.

Thus, when the cervical spine of a human body is placed, the cervical spine is supported by the front side layer 111 and the back side layer 112 of the two-layer structure in the area from the front edge of the cervical spine support part 11 to more than half of the area in the front-back direction; and in the area behind that the cervical spine is supported only by the frontside layer 111 without support by the back side layer 112. Therefore, in the rear part of the cervical spine support part 11, the front side layer 111 is flexed by the weight of the head to firmly support the cervical spine in the front two-layered portion of the cervical spine support part 11, while the surface gently slopes from the cervical spine support part 11 to the occipital support part 12 to support the cervical spine and occipital in an appropriate shape along its surface.

If the dimension of the front-back direction of the back side layer 112 is less than ½ of the front side layer 111, it is difficult to hold the cervical spine support part 11 at an appropriate height; and if it exceeds ¾, the front side layer 111 deflects less, making support along the surface shape from the cervical spine to the occipital difficult.

The openings and stoppers 21 of both pouches 201, 202 of the cervical spine support part 11 are formed on the mating surfaces of the front side layer 111 and the back side layer 112. This allows for easy adjustment of both the filler materials 31 and 32 in the front side layer 111 and the back side layer 112, making it easy to adjust the height by flattening or concentrating the filler materials 31, 32 in the center, thereby omitting the need to adjust the contents.

(Configuration of Occipital Support Part)

The occipital support part 12 has a posterior back pouch 205 and an occipital front pouch 204, which is formed on the posterior back pouch 205 and forms the surface of the occipital support part 12; the posterior back pouch 205 contains one sheet-like body 33. The sheet-like molded body 33 is formed, for example, by a urethane sheet made of polyurethane foam of uniform thickness, which is produced by mixing a foaming agent with polyurethane and curing it through a chemical reaction, for example. Nothing is filled in the occipital front pouch 204; and the surface of the pouch 204 only forms the surface of the occipital support part 12. The sagging surface of the occipital front pouch 204 forms the thinnest part 120, which is the smallest in height of the pillow 10, at approximately its center.

Figure 4:
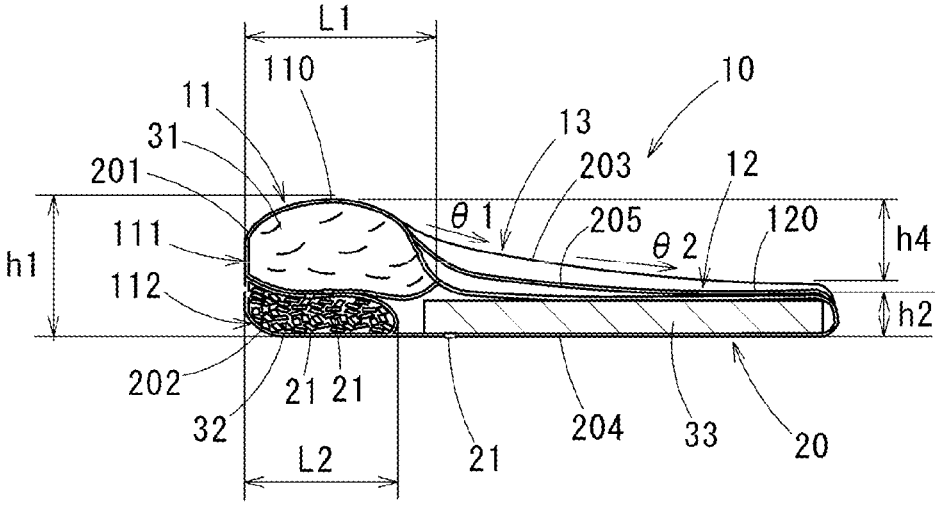
FIG. 4 It is a cross sectional view showing a cross section cut along the line A1-A1 shown in FIG. 2.

The width dimension of the occipital support part 12 is 15 cm to 27 cm, its depth dimension is 20 cm to 35 cm, and its thickness (height) is lower than that of the temporal head support part 13, which is 1 cm or more and 2 cm or less at the thinnest part 120 (see FIG. 4).

If the height h2 of the thinnest part 120 of the pillow 10 is less than 1 cm, the back of the head is too low to be properly supported; and if the height h2 exceeds 2 cm, the back of the head is too high to be properly supported by the cervical spine support part 11. The height h2 of the thinnest part 120 is more preferably 1 cm or more and 1.5 cm or less.

(Configuration of Temporal Head Support Part)

The temporal head support part 13 is provided in a two-layered structure with a posterior back pouch 205 integrated with the lower space of the aforementioned occipital support part 12 and temporal head front pouches 203 formed on both ends in the width direction; and the temporal head front pouches 203 are filled with the granular filler material 32. The posterior back pouch 205 contains the sheet-like molded body 33, as described above.

It is possible to fill the temporal head front pouch 203 with a material (soft filler) similar to the soft filler material 31 in the cervical spine front pouch 201 instead of the granular filler material 32; but it is preferable to use a material with higher resilience than that used in the cervical spine front pouch 201.

Figure 5:
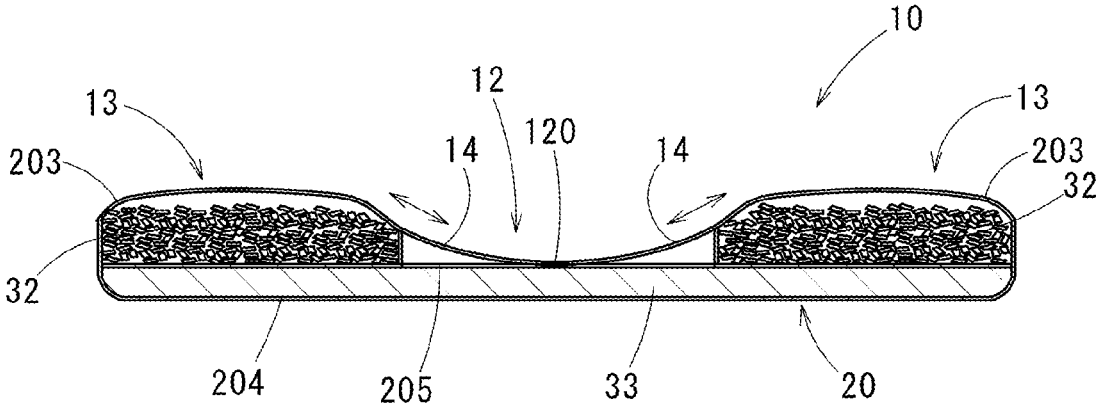
FIG. 5 It is a cross sectional view showing a cross section cut along the line B1-B1 shown in FIG. 2.

The granular filler material 32 is made of the same material and the same shape as the granular filler material 32 filled in the cervical spine back pouch 202; however, in the back side layer 112 of the cervical spine support part 11, the granular filler material 32 is almost fully filled in the cervical spine back pouch 202, whereas in the temporal head support part 13, as shown in FIG. 5, it is filled with a gap formed in relation to the inner volume of the temporal head front pouches 203, as shown in FIG. 5. In other words, the filling density of the granular filler material 32 is smaller in the temporal head front pouches 203 than in the cervical spine back pouch 202 (i.e., the filling density of the cervical spine back pouch 202 is greater than that of the temporal head front pouch 203). This facilitates the flow of the granular filler material 32 within the temporal head front pouches 203, and when the human head moves on the temporal head support part 13, the granular filler 32 in the temporal head front pouches 203 can move within the pouches 203 in response to that movement.

In this embodiment, the front side of the temporal head support part 13 is composed of a layer of the granular filler material (resin pipe) 32 and the back side is composed of a layer of the sheet-like molded body (urethane sheet) 33. This two-layer structure allows the cervical spine support part 11 to be connected without a step, allowing the height to gradually decrease as it moves toward the back, and the layer of urethane sheet maintains the temporal head support parts 13 in a stable shape and also ensures appropriate resilience.

If the content of the temporal head support parts 13 is only the granular filler material (resin pipe) 32, the resilience of the temporal head support parts 13 is too small, and furthermore, depending on the hardness and shape of the granular filler material 32, it may put a strain on the temporal head. If the contents of the temporal head support part 13 consist only of the sheet-like molded body (urethane sheet) 33, depending on its shape, the dimension in the width direction that can properly support the temporal head may be too small.

If a layer of the sheet-like molded body (urethane sheet) 33 is located on the front side of the temporal head support part 13 and a layer of the granular filler material (resin pipe) 32 is located on the back side, the sheet-like molded body 33 cannot be used in common with the occipital support part 12 and another urethane sheet must be accommodated. Furthermore, the height cannot be progressively reduced toward the back from the connection with the cervical spine support part 11, and there may be problems such that the width dimension may become too small to support the temporal head.

The surface of the temporal head support part 13 is sloped downward from the connection portion with the cervical spine support part 11 toward the rear, and the angle of inclination with respect to the horizontal plane is set at a two-step angle of inclination, with a first angle θ1 on the connection portion with the cervical spine support part 11 being larger and a second angle θ2 in the central part in the front-back direction being smaller.

The difference (h4) between the height of the innermost side of the temporal head support part 13 and the height of the top 110 of the cervical spine support part 11 (maximum height h1) is 4 cm or more and 8 cm or less. This difference is more preferably 3 cm or more and 7 cm or less.

The height of the innermost side of the temporal head support part 13 is set 1 cm or more and 2 cm or less, but since the sheet-like molded body 33 of the occipital support part 12 is shared, it is set equal to or slightly higher than the height of the occipital support part 12 (thinnest part 120).

Sloping surfaces 14 are formed to slope downward from the temporal head support part 13 to the thinnest part 120 of the occipital support part 12, making it easier to turn over. The angle of inclination of the sloping surfaces 14 with respect to the horizontal plane is preferably 10° or more and 60° or less; more preferably, 20° or more and 30° or less.

The dimension of each of the temporal head support parts 13 in the width direction is 15 cm to 27 cm, and in the depth direction is 20 cm to 35 cm. Furthermore, the stoppers 21 of the temporal head front pouches 203 in the temporal head support parts 13 are formed near the connection with the cervical spine front pouch 201, which constitutes the front side layer 111 of the cervical spine support part 11.

In addition, the temporal head front pouches 203 have seam parts 50 formed along the width direction, which are made by linearly sewing a part of the pouches 203 together at the central part except for the peripheral part. In the example shown in FIGS. 1 and 2, two seam parts 50 are formed almost parallel along the width direction, and although the interior space is divided by the seam parts 50, they are interconnected at the periphery, so that the interior granular filler material 32 moves through the area divided by the seam parts 50, and the movement is restricted. Then, it is possible to easily adjust the height and volume of the granular filler material 32 filled in the pouches 203, such as more on the front side and less on the back side, thereby reducing the time and effort required to adjust the contents.

[Compressive Properties of Each Support Portion]

Since the front side layer 111 of the cervical spine support part 11 is formed by a layer of soft filler material 31, a linearity LC of the compression property is smaller than that of the temporal head support part 13 in which the front side layer 111 is composed of the granular filler material 32, and the ease of compression in the initial stage of compression is superior. The cervical spine support part 11 has both a greater compression workload WC and compression recovery RC than the temporal head support part 13, and has superior overall compressibility and recovery after compression.

Here, compressive property means the relationship between thickness and pressure when compressed perpendicular to the surface. Linearity LC of compression properties is a parameter that expresses how close the relationship between thickness and pressure is to a straight line; a smaller value indicates a softer material that is easier to compress in the initial stage of compression. The compression workload WC is a parameter that indicates the amount of workload up to the maximum pressure; a larger value indicates a material that is easier to compress (easy to collapse). The compression recovery RC is a parameter that indicates the recoverability after compression; a higher value indicates a material that easily recovers its shape.

Figure 6:
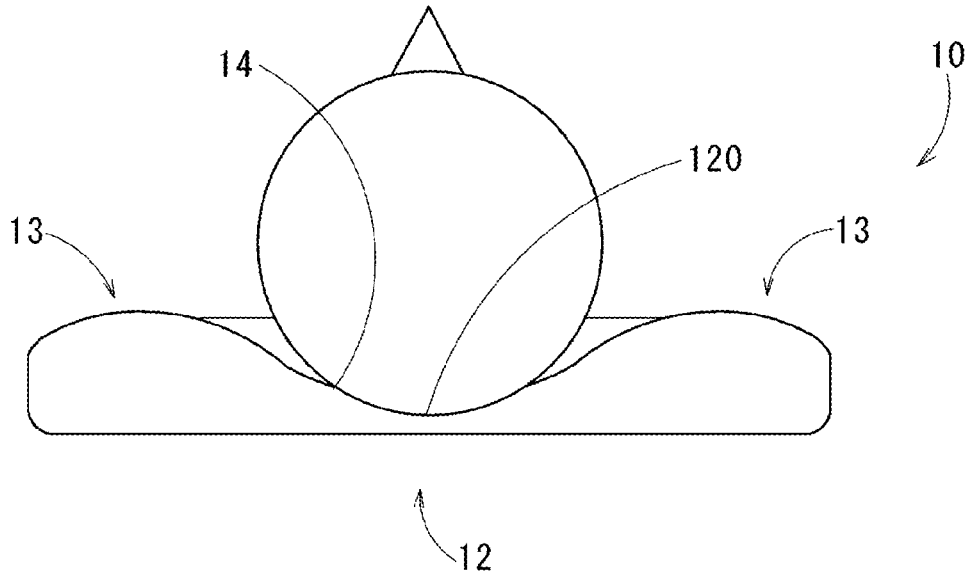
FIG. 6 It is a schematic view showing how the occiput head of a user using the pillow of the above-mentioned embodiment is supported.
Figure 7:
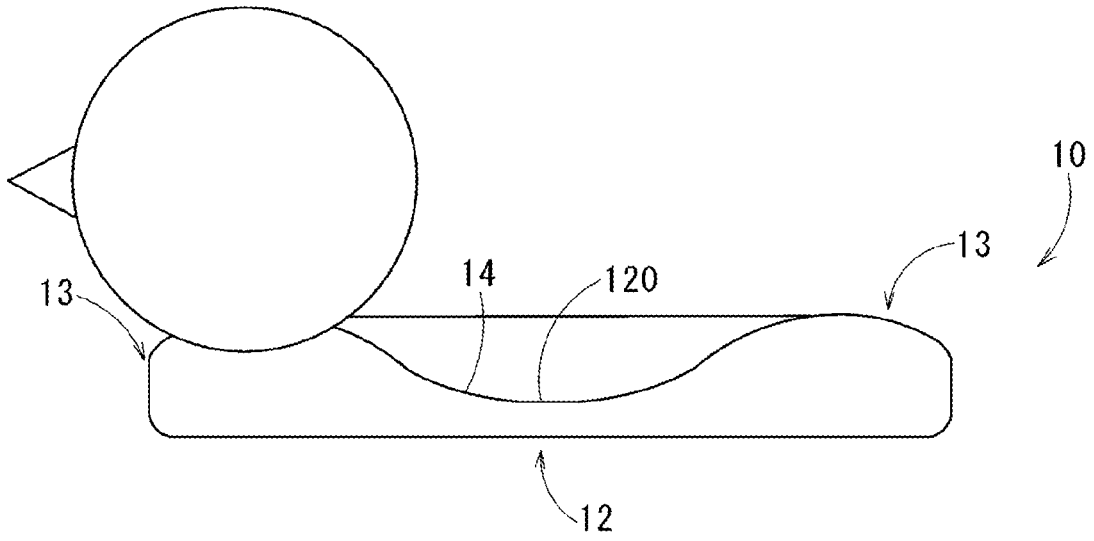
FIG. 7 It is a schematic view showing how the temporal head of a user using the pillow of the above-mentioned embodiment is supported.
Figure 8:
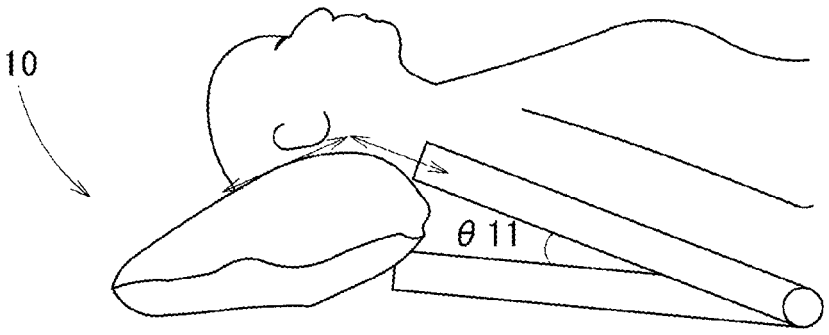
FIG. 8 It is a schematic view of the user in the state of FIG. 6, viewed from a side of the pillow.
Figure 9:
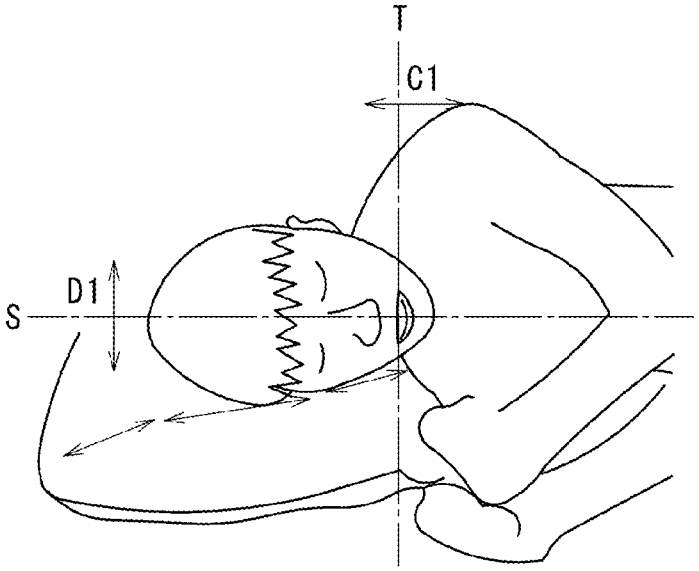
FIG. 9 It is a schematic view of the user in the state of FIG. 7, viewed from the side of the pillow.

In the pillow 10 of the present embodiment, the cervical spine support part 11, the occipital support member 12, and the temporal head support member 13 are integrated by the bag body 20, and the height of each of the cervical spine, the occipital, and the temporal head support members 11 to 13 is set as described above, so that in both the cases of the supine posture shown in FIGS. 6 and 8 and the recumbent position shown in FIGS. 7 and 9, the cervical spine, the head, and the temporal head can be properly supported, and the airway can be secured without stressing the cervical spine.

Specifically, in the case of lying on the back, the user's cervical spine is properly supported by the cervical spine support member 11, as shown in FIG. 8, so that an angle θ11 of the cervical spine relative to a floor surface on which the user lies can be an ideal about 17°. By maintaining the angle of the cervical spine relative to the floor surface in this manner, it physically generates a hyper-lordosis of the cervical spine to improve straight neck, which is a relative over-kyphosis, and it also promotes stretching of a platysma muscles over the entire cervical part to provide a cosmetic effect of elongating the neck and jaw wrinkles.

In the case of recumbent position, a transverse plane T and a sagittal plane center of gravity line S change in the range of 10° to 20° in a direction of the arrows C1 and D1 when the pillow user changes the position of his/her arms. Therefore, the pillow 10 must have a shape that does not place a load on the neck or head, even if the position of the arm that is on the upper side changes while lying on the side.

In addition, if the position of the arm that is on the lower side is directly under the upper body, the upper half of the body is supported only by the upper arm, which reduces the support area. Therefore, the height of the pillow 10 must be set appropriately, under a premise that the arms are on the chest side and the lying body is supported by the lying body by the upper arms, the shoulder blades, and the side chest and the side abdomen.

In the pillow 10 of this embodiment, each of the support portions 11 to 13 is integrated by the bag body 20, and the height and accommodated members are set as described above for each area supporting the cervical spine, the occipital and the temporal head, so that the cervical spine can be properly supported by the cervical spine support part 11 even in a recumbent position; and the temporal head can be properly supported by the temporal head support parts 13.

In addition, the cervical spine support part 11 is superior to the temporal support head support portions 13 in ease of compression at the initial stage of compression, in overall compressibility, and in recoverability after compression, and since the resilience of the temporal head support parts 13 is greater than that of the cervical spine support part 11; as shown in FIGS. 7 and 9, it can support the temporal head of a person who has turned over in bed and is now lying on his/her side while sinking appropriately; so that when the user turns over in bed, the cervical spine is surely not subjected to excessive tension.

In particular, when the person turns over naturally, the shoulder joint is in an adducted and internally rotated position, but the cervical spine can continue to be supported by the cervical spine support part 11. The height of the temporal head support members 13 is formed lower on the back side, so that the temporal head is properly supported when the person turns over in the shoulder joint adduction internal rotation position, and the upper body can be stably supported in the three areas of the posterior humerus and acromion to avoid excess tension on the cervical spine when the person turns over in bed.

In this case, the occipital support part 12 is formed lower than the temporal head support parts 13, the cervical spine support part 11 is formed across the width direction of the pillow 10, and the height of the temporal support portions 13 is progressively smaller toward the back, so that the head position can be easily changed when the body position is changed from lying on the back to lying down. This makes it easy to change the head position when changing the body position from the supine posture to the recumbent position. Specifically, the height of the occipital support part 12 is formed to be the lowest, 1 cm or more and 2 cm or less, so that the occipital can be properly supported without sinking too much.

In particular, for users who lie on a bed or mattress, the weight of the body causes the mattress to sink down and the pillow to rise relatively high, which increases the load on the neck and shoulders; but in this embodiment, the height of the occipital support part 12 is formed quite low, so that it is certainly possible to reduce the load on the cervical spine and shoulders even when the user uses a bed or mattress.

Furthermore, as shown in FIG. 13, even when the shoulder joint is raised to the neck side with the user's temporal head supported and the skull is pushed obliquely upward, the height of the temporal head support part 13 is formed with progressively smaller height toward the back, so that the temporal head of the skull is properly supported; thus, the load on the P1 region of the skull can be reduced.

Since the height of the thinnest part 120 of the occipital support part 12 is as thin as 1 cm to 2 cm, and the cervical spine support part 11 is 3.0 times or more higher than the occipital support part 12, it properly supports the cervical spine when the occipital rests on the occipital support part 12; thereby ensuring that the neck muscles are not tense. Furthermore, since the occipital support part 12 is formed by the sheet-like molded body (urethane sheet) 33, the height of the occipital support part 12 can be changed as needed between 1 cm and 2 cm simply by changing the thickness or number of sheets of the sheet-like molded body 33.

In addition, since the layer of the granular filler material (resin pipe) 32 is placed in the back side layer 112 of the cervical spine support part 11 and the layer of the soft filler material (polyester fluff) 111 is placed in the front side layer 111, the front side layer 111 softly enfolds and supports the cervical spine and the back side layer 112 with high resilience supports this front side layer 111, thereby preventing the cervical spine support part 11 from losing its shape.

In addition, in the temporal head support parts 13, the sheet-like molded body (urethane sheet) 33 is placed on the back side, and the granular filler material (resin pipe) 32 is placed on the front side, so the height of the temporal head support part 13 can be progressively higher toward the back side.

In addition, since the back sides of the occipital support part 12 and the temporal head support parts 13 are constructed from the sheet-like molded body 33, the stability of the pillow can be improved compared to a case in which the back sides of the occipital support part 12 and the temporal head support part 13 are constructed as separate bodies, and the shape of the temporal head support part 13 can be stably maintained by the sheet-like molded body 33. Therefore, the user can easily turn over, the load on the cervical spine can be reduced even when lying on his/her side, and the airway can be secured.

In addition, since the openings and stoppers 21 are provided in each pouch 201 to 204 constituting the cervical spine support part 11 and the temporal head support parts 13, the amount of internal soft filler material 31 and the granular filler material 32 can be adjusted, thereby maintaining proper support for the head and cervical spine of the user of the pillow 10. In other words, it is possible to suppress changes in the height of each of the support portions 11 to 13 due to aging deterioration.

Furthermore, the pillow 10 can be kept clean due to the antibacterial and deodorizing effects of the granular filler material 32 and the soft filler material 31 that form part of the cervical spine support part 11 and the temporal head support parts 13. In addition, the layer of soft filler material 31 of the cervical spine support part 11 wears down in height when the cervical spine is pressed against it, so as the usage time increases, the height becomes appropriate for the user's muscle tension level and the distortion of the cervical spine, and the stress can be reduced.

Note that the present invention is not limited to the above-described embodiments, and various changes may be made without departing from the scope of the present invention, for example, the following changes are also possible.

For example, in the above embodiment, the granular filler material filled into the bag body 20 is a large amount of small resin pipes, but is not limited to this, and may be two or three long resin pipes.

In the embodiment described above, the temporal head support parts 13 include the granular filler material and the sheet-like molded body, but is not limited to this, for example, the soft filler material may be used instead of the granular filler material, or it is possible to use a single layer of only the sheet-like molded body.

In the above embodiment, each of the pouches 201 to 205 of the bag body 20 is provided with the opening and the stopper 21, but the present invention is not limited to this; for example, such openings and stoppers 21 are not necessarily provided since the thickness of the occipital support part 12 is extremely small and there is no sinking.

The material, shape, size, number, arrangement location, etc. of each component in the above embodiments are arbitrary as long as the present invention can be achieved, and are not limited.

EXAMPLES

A pillow having the same shape as the pillow shown in the above embodiment was manufactured. Specifically, the pillow was produced as follows: in plan view, the width dimension was 67 cm, and the depth dimension was 36 cm; the cervical spine support part had the width direction dimension of 67 cm, the depth dimension of 11 cm, and the height of the top 8.3 cm; the occipital support part had the width dimension of 21 cm, the depth dimension of 25 cm, and the height of the thinnest part of 2 cm; and the temporal head support part had the width dimension of 23 cm, the depth dimension of 25 cm, and the height at the deepest part of 3 cm.

The cervical spine support part was made from a layer of polyester fluff for the front side layer and a layer of resin pipes for the back side layer with the height 3 cm of the resin pipe layer (back side layer. The resin pipe having an outer diameter 5 mm and a length 8 mm was used. The occipital support part had one urethane sheet made of polyurethane foam accommodated in the posterior back pouch, and the thickness was 2 cm. The temporal head support part was conformed of a layer of a urethane sheet and a layer of resin pipes filled in the occipital front pouch above the urethane sheet layer.

(Method of Calculating Compression Properties)

Figure 10:
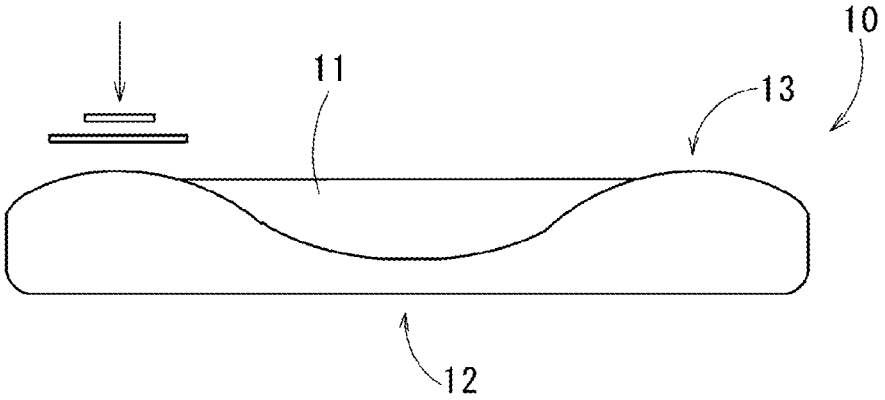
FIG. 10 It is a schematic view showing a pressurization of a pillow in an example of the present invention.

As for the compression properties, as shown in FIG. 10, a disk-shaped compression jig with a diameter of 100 mm was placed on the pillow 10, using the handy compression tester (KEG-G5 manufactured by Kato Tech Co., Ltd.), and the compression properties were calculated at each of the cervical spine support part and the temporal head support part when compressing to a maximum load of 6 kgf at a speed of 10 mm/min; the compression properties were the linearity LC, the compression workload WC (mm gf/78.5 $cm^2$), and the recovery amount of compression RC (%) of the compression properties. This calculation was performed five times, and the average value was shown in Table 1.

In addition, the compression jig was brought into contact with the top of the cervical spine support part, and the compression jig was brought into contact with the middle part of the temporal head support part in the front-back direction (the same applies to the next repeated compression test).

(Repeated Compression Test)

Using an Amsler type testing machine (manufactured by Kato Tech Co., Ltd.: automated compression testing machine KES-FB3-AUTO-A), a repeated compression test was performed on each of the cervical spine support part and the temporal head support part. A compressor of this testing machine is disc-shaped and has a diameter of approximately 110 mm, and the compressor was compressed 36,000 times at a load of 6 kgf and a test speed of once every two seconds to compress the cervical spine support part and the temporal head support part; then, the heights of the cervical spine support part and the temporal head support parts were measured immediately after the compression treatment and 24 hours after the compression treatment. The results were shown in Table 2.

(Evaluation of Relaxation when Using Pillow)

In order to evaluate whether the user can actually relax when using the pillow described above, LF/HF, which is a sympathetic nerve activity index (stress index) that measures a balance of autonomic nervous function, was used. The LF/HF was calculated from time-series data of heart rate fluctuations to estimate the balance of the autonomic nervous system from heart rate fluctuations, by extracting high frequency fluctuation component (HF component) corresponding to respiratory fluctuation and low frequency component (LF component) corresponding to Mayer wave, which is blood pressure fluctuation, and comparing the magnitudes of them.

The HF component reflecting the respiratory fluctuation appears in the heart rate fluctuation only when parasympathetic nerve gets nervous (activated). Whereas, the LF component has characteristic of appearing in the heart rate fluctuation both when the sympathetic nerve gets nervous and when the parasympathetic nerve gets nervous. The heart rate fluctuation was classified into the LF and the HF and analyzed by using TAS9 manufactured by YKC Co., Ltd. The time for one measurement was five minutes.

Furthermore, salivary amylase activity values were measured simultaneously with the LF/HF measurements. This salivary amylase activity value was measured using an enzyme analyzer (manufactured by Nipro Corporation: Amylase Monitor). The experiment involved followings:

performing a 100-square calculation (a learning method for calculating multiplication and other calculations using a 10×10 grid) in a sitting position; then resting as it was for 15 minutes; and then moving to a pipe bed with a cushion, where the above-mentioned pillow was placed, and then resting for 15 minutes in a supine posture with his/her head resting on the pillow (as shown in FIG. 8). In addition, in the supine state, a towel blanket was used and the lights were turned off. The room temperature was 25° C. and the humidity was 50%.

For LF/HF, electrocardiogram measurements were performed over time, and the values were calculated when performing the 100-square calculation, when resting in a sitting position, and when resting supine using a pillow. The salivary amylase activity values were measured before performing the 100-square calculation, immediately after performing the 100-square calculation, and immediately after resting using the pillow for 15 minutes.

Figure 11:
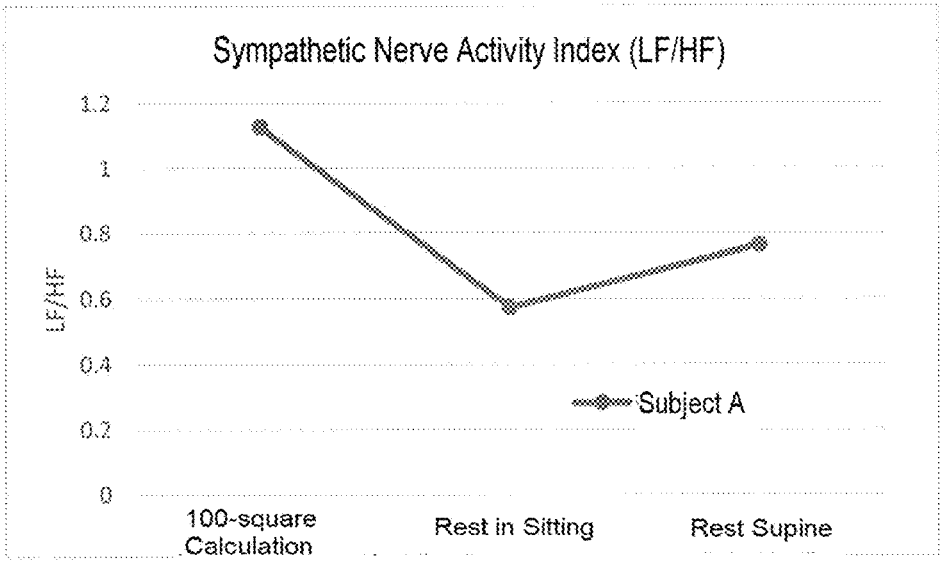
FIG. 11 It is a view showing an experimental result in sympathetic nerve activity in an example of the present invention.
Figure 11:
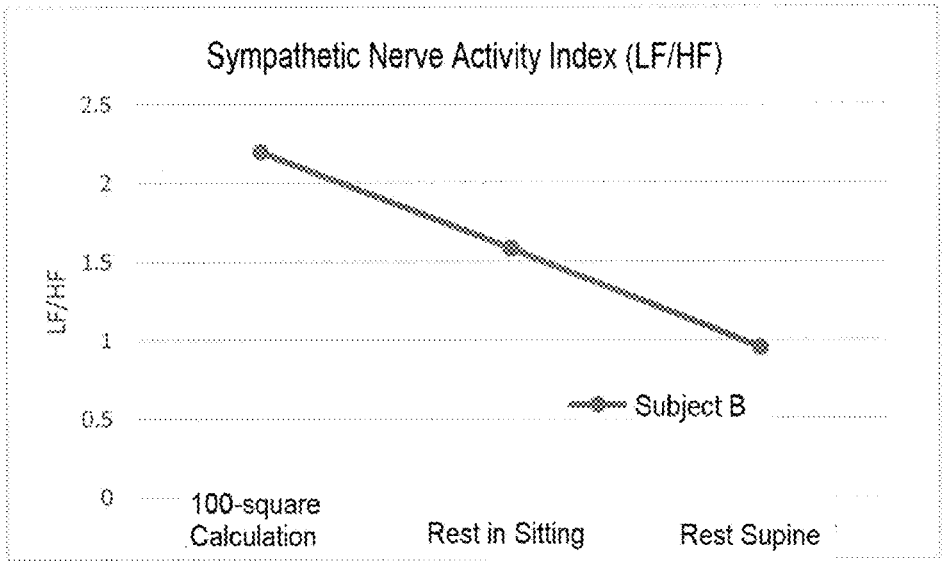
Figure 11:
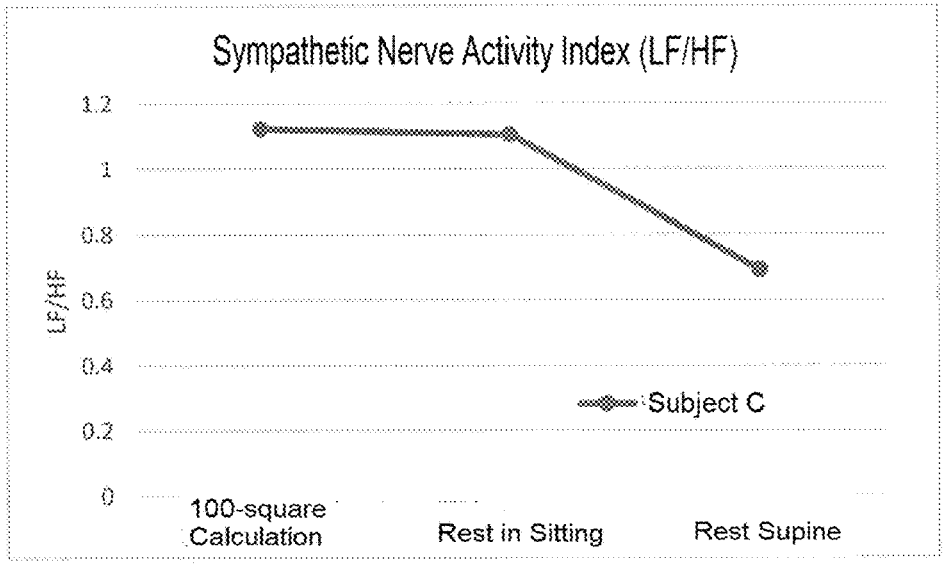
Figure 12:
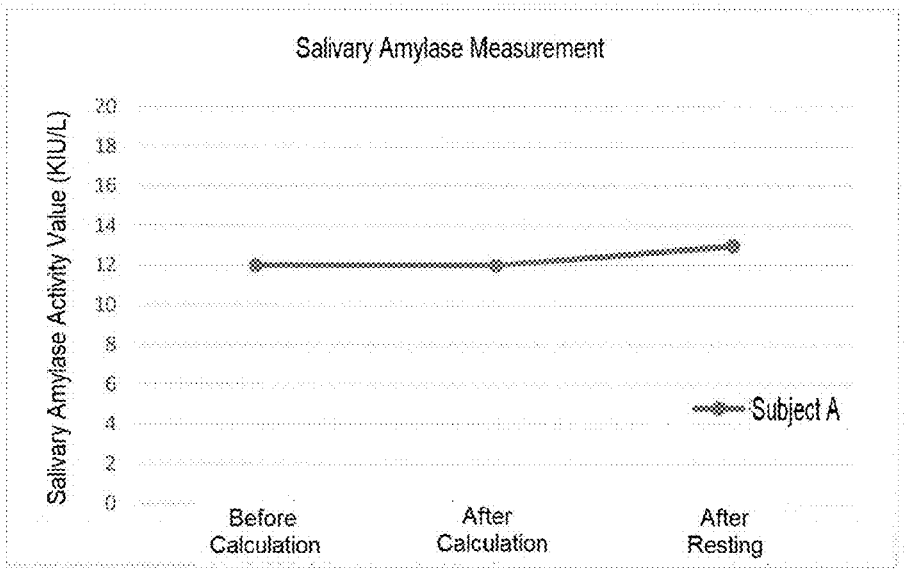
FIG. 12 It is a view showing a result of salivary amylase measurement in an example of the present invention.
Figure 12:
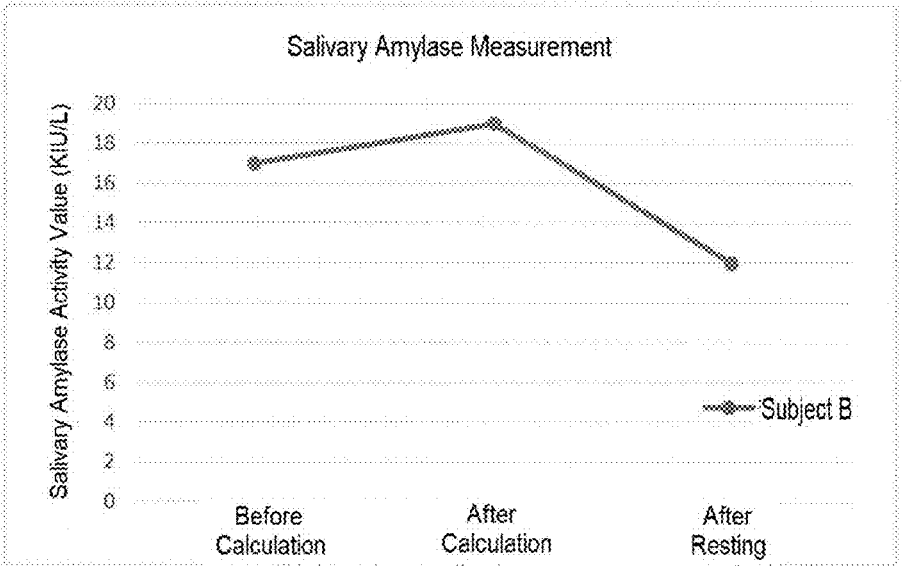
Figure 12:
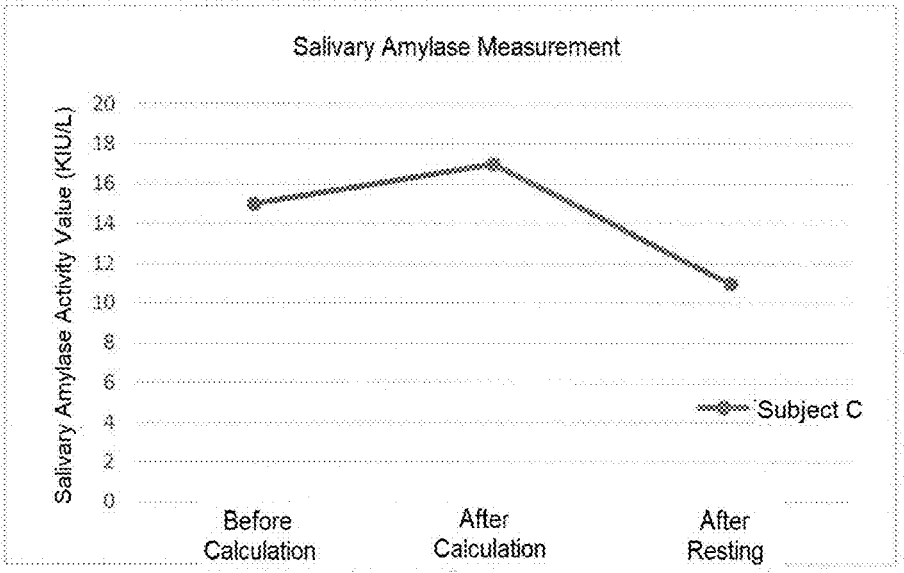

In addition, there were three subjects in the above experiment. Subject A was 60 years old, female, height 156 cm, and 60 kg; Subject B was 34 years old, female, height 159 cm, and 46 kg; Subject C was 36 years old, male, 168 cm, and weight 68 kg. Among the experimental results, the results of the sympathetic nerve activity index LF/HF are shown in FIG. 11, and the results of the salivary amylase activity value are shown in FIG. 12.

TABLE 1

| | Support Portion | |
|---|---|---|
| Compression Property | Cervical Spine | Temporal Head |
| L C | 0.428 | 0.646 |
| WC (mm · gf/78.5 $cm^2$) | 58784 | 51896 |
| RC (%) | 44.36 | 37.88 |

TABLE 2

| | Support Portion | |
|---|---|---|
| Thickness (mm) | Cervical Spine | Temporal Head |
| Initial | 83.0 | 52.5 |
| Immediately after Compression | 73.0 | 52.0 |
| 24 hours after Compression | 82.0 | 52.5 |

It was found from Table 1 that the cervical spine support part was superior to the temporal head support part in its ease of compression at the initial stage of compression, was superior to the temporal head support part in its overall compressibility, and was superior in recoverability after compression.

It was found from Table 2 that the initial thickness and the thickness 24 hours after the compression treatment were the same in the temporal head support part, so that the recoverability after compression was particularly high. Although the thickness of the cervical spine support part was significantly reduced immediately after compression compared to the initial thickness, the difference between the thickness 24 hours after the compression treatment and the initial thickness was 1.0 mm, indicating that the cervical spine support part also recovered well after compression. In other words, it was found that the above pillow had excellent durability.

From FIG. 11, it was found that for the subjects B and C, LF/HF was lowest when they were in a supine posture using the pillow, indicating that they were able to relieve stress with the pillow. It was also found from FIG. 12 that the salivary amylase activity values were lowest in the subjects B and C after the supine posture using the pillow, also indicating that the stress can be reduced by the pillow.

INDUSTRIAL APPLICABILITY

To provide a pillow that can secure the airway without causing tension in the neck muscles in both lying on the back and on the side, and can also alleviate straight neck.

REFERENCE SIGNS LIST

10 . . . Pillow
11 . . . Cervical spine support part
12 . . . Occipital support part
120 . . . Thinnest part
13 . . . Temporal head support part
14 . . . Sloping surface
20 . . . Bag body
21 . . . Stopper
31 . . . Soft filler material (accommodated member)
32 . . . Granular filler material (accommodated member)
33 . . . Sheet-like molded body (accommodated member)
111 . . . Front side layer
112 . . . Back side layer
201 . . . Cervical spine front pouch
202 . . . Cervical spine back pouch
203 . . . Temporal head front pouch
204 . . . Occipital front pouch
205 . . . Posterior back pouch

The invention claimed is:

1. A pillow configured to support a head of a human body in a supine posture, the pillow comprising;

a bag body and a plurality of kinds of accommodated members housed in the bag body, a cervical spine support part provided along a width direction to support a cervical spine;

an occipital support part connected to a rear edge of the cervical spine support part at a center except for at both ends in the width direction of the cervical spine support part to support an occiput, and the occipital support part extending toward a rear of the pillow; and two temporal head support parts connected to a first and second end of the rear edge of the cervical spine support part and connected to a first side edge and a second side edge of the occipital support part extending toward the rear of the pillow to support a temporal region of the head, wherein the cervical spine support part is provided with a top along the width direction; a thinnest part with a smallest height is provided in the occipital support part; surfaces of the two temporal head support parts slope downward toward the rear of the pillow and the surfaces from the temporal head support parts to the occipital support part slope downward toward the thinnest part, wherein the bag body is provided at least with a cervical spine front pouch and a cervical spine back pouch dividing the cervical spine support part into a front side layer and a back side layer; two temporal head front pouches forming a front side of the temporal head support parts; and a posterior back pouch that connects lower spaces of the temporal head front pouches through a lower space of the occipital support part; wherein the accommodated members comprising a flexible soft filler material, a granular filler material with greater resilience than the soft filler material, and a sheet molded body; and the cervical spine front pouch is filled with the soft filler material, the cervical spine back pouch is filled with the granular filler material, and the posterior back pouch stores the sheet molded body; and wherein in the cervical spine support part, the cervical spine front pouch and the cervical spine back pouch are joined at their front edge, and a first dimension of the back side layer is smaller than a second dimension of the front side layer.

2. The pillow according to claim 1, wherein the granular filler material is filled in the temporal head front pouches, a filling density in the temporal head front pouches is smaller than a filling density in the cervical spine back pouch, and the granular filler material is possible to move within the temporal head front pouches.

3. The pillow according to claim 1, wherein the surfaces of the temporal head support parts are formed with a first angle at a connection side with the cervical spine support part being larger than a second angle at a center, the second angle being an inclination angle to a horizontal plane.

4. The pillow according to claim 1, wherein the height of the thinnest part of the occipital support part is between 1 cm and 2 cm, and a height of the top of the cervical spine support part is between 3 times and 9 times the height of the occipital support part.

5. The pillow according to claim 1, wherein when the pillow is compressed to a maximum load of 6 kgf at a speed of 10 mm/min using a 100 mm diameter disc-shaped compression jig, a linearity of compression property of the cervical spine support part is LC1, a linearity of compression property of the temporal head support part is LC2, a compression workload of the cervical spine support part is WC1 (mm·gf/78.5 $cm^2$), a compression workload of the temporal head support parts is WC2 (mm·gf/78.5 $cm^2$), a recovery amount of compression of the cervical spine support part is RC1 (%), and a recovery amount of compression of the temporal head support parts is RC2 (%), LC1<LC2, WC1>WC2, and RC1>RC2.

* * * * *